US010119297B2

(12) United States Patent
Choi

(10) Patent No.: US 10,119,297 B2
(45) Date of Patent: Nov. 6, 2018

(54) EAVE STRUCTURE AND TENT FRAME WITH INTEGRATED EAVE STRUCTURE

(71) Applicant: Campvalley (Xiamen) Co. Ltd., Xiamen (CN)

(72) Inventor: Kwan Jun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days.

(21) Appl. No.: 15/709,234

(22) Filed: Sep. 19, 2017

(65) Prior Publication Data

US 2018/0080243 A1 Mar. 22, 2018

(30) Foreign Application Priority Data

Sep. 19, 2016 (CN) ..... 2016 2 1061701 U

(51) Int. Cl.
*E04H 15/46* (2006.01)
*E04H 15/50* (2006.01)

(52) U.S. Cl.
CPC ..... *E04H 15/46* (2013.01); *E04H 15/50* (2013.01)

(58) Field of Classification Search
CPC ..... E04H 15/50; E04H 15/46
See application file for complete search history.

(56) References Cited

U.S. PATENT DOCUMENTS 1,061,547 A 5/1913 Kennedy
1,347,107 A 7/1920 McCann
3,888,056 A 6/1975 Kelly
4,286,612 A 9/1981 Neal
4,630,627 A 12/1986 Windows
4,641,676 A 2/1987 Lynch
4,793,371 A 12/1988 O'Ferrell
4,944,321 A 7/1990 Moyet-Ortiz
5,224,507 A 7/1993 Vosse
5,275,188 A 1/1994 Tsai
5,421,356 A 6/1995 Lynch
(Continued)

FOREIGN PATENT DOCUMENTS

CA 2895981 A1 12/2015
CN 201202302 Y 3/2009
(Continued)

OTHER PUBLICATIONS

U.S. Appl. No. 14/753,989, filed Jun. 29, 2015.
(Continued)

*Primary Examiner* — Noah Chandler Hawk
(74) *Attorney, Agent, or Firm* — Morgan, Lewis & Bockius LLP

(57) ABSTRACT

Disclosed are eave structures and tent frames with integrated eave structures. A tent frame includes supporting poles, an upper frame coupled with the supporting poles, and two or more eave structures. An eave structure includes an eave pole, and a sleeve member disposed at a connector coupled with a supporting pole. The eave pole has a first end portion pivotally connected with an upper pole of the upper frame, and a second end portion slidably coupled with the sleeve member. The eave structures can be folded and unfolded together with the supporting poles and the upper frame. When unfolded, the eave poles of the eave structures extend beyond the upper frame.

16 Claims, 10 Drawing Sheets

(56) References Cited

U.S. PATENT DOCUMENTS

| | | | | |
|---|---|---|---|---|
| 5,794,640 | A | 8/1998 | Jang | |
| 5,813,425 | A | 9/1998 | Carter | |
| 5,944,040 | A | 8/1999 | Jang | |
| 6,182,917 | B1 | 2/2001 | Lai | |
| 6,206,020 | B1 | 3/2001 | Lynch | |
| 6,463,948 | B2 | 10/2002 | Lee | |
| 6,598,614 | B2 | 7/2003 | Liu | |
| 6,708,707 | B2 | 3/2004 | Dotterweich | |
| 6,718,995 | B2 | 4/2004 | Dotterweich | |
| 6,848,461 | B2 | 2/2005 | Tsai | |
| 6,929,017 | B2 | 8/2005 | Byun | |
| 7,055,538 | B2 | 6/2006 | Deng | |
| 7,240,686 | B2 | 7/2007 | Seo | |
| 7,296,584 | B2 | 11/2007 | Goldwitz | |
| 7,316,239 | B2 | 1/2008 | Yang | |
| 7,360,549 | B2 | 4/2008 | Seo | |
| 7,395,830 | B2 | 7/2008 | Seo | |
| 7,422,026 | B2 | 9/2008 | Kim | |
| 8,220,477 | B2 | 7/2012 | Park | |
| 8,544,489 | B2 * | 10/2013 | Choi | E04H 15/50 135/140 |
| 8,616,226 | B2 * | 12/2013 | Ma | E04H 15/50 135/145 |
| 8,701,692 | B2 * | 4/2014 | Holland | E04H 15/50 135/122 |
| D705,884 | S | 5/2014 | Jin | |
| 8,776,816 | B2 | 7/2014 | Danziger | |
| 8,893,737 | B2 | 11/2014 | Yang | |
| 8,910,648 | B2 | 12/2014 | Jin | |
| 9,243,422 | B2 | 1/2016 | Hunt | |
| 9,528,292 | B1 | 12/2016 | Lovely, II | |
| 9,580,929 | B2 * | 2/2017 | Ma | E04H 15/50 |
| 9,739,073 | B2 | 8/2017 | Huang | |
| 9,869,110 | B2 | 1/2018 | Krenzel | |
| 9,926,720 | B2 * | 3/2018 | Huang | E04H 15/322 |
| 2002/0074032 | A1 | 6/2002 | Park | |
| 2004/0144412 | A1 * | 7/2004 | Tsai | E04H 15/50 135/131 |
| 2005/0241688 | A1 | 11/2005 | Wu | |
| 2006/0169312 | A1 | 8/2006 | Choi | |
| 2007/0012347 | A1 | 1/2007 | Ochi | |
| 2007/0051397 | A1 | 3/2007 | Choi | |
| 2007/0144572 | A1 | 6/2007 | Patel | |
| 2007/0221262 | A1 * | 9/2007 | Tsai | E04H 15/50 135/145 |
| 2009/0032079 | A1 | 2/2009 | Choi | |
| 2010/0043856 | A1 | 2/2010 | Park | |
| 2011/0073148 | A1 | 3/2011 | Choi | |
| 2012/0291830 | A1 | 11/2012 | Crimi | |
| 2013/0014794 | A1 | 1/2013 | Jin | |
| 2013/0247948 | A1 | 9/2013 | Lovely et al. | |
| 2013/0284225 | A1 | 10/2013 | Holland | |
| 2014/0174491 | A1 | 6/2014 | Yang | |
| 2014/0261601 | A1 | 9/2014 | Jin | |
| 2014/0261602 | A1 | 9/2014 | Ampoyo | |
| 2014/0290710 | A1 | 10/2014 | Choi | |
| 2015/0083177 | A1 | 3/2015 | Hotes | |
| 2015/0247339 | A1 | 9/2015 | Lee | |
| 2015/0308147 | A1 | 10/2015 | Lee | |
| 2015/0376913 | A1 | 12/2015 | Choi | |
| 2016/0108639 | A1 | 4/2016 | Huang | |
| 2016/0348392 | A1 | 12/2016 | Jin | |
| 2017/0121999 | A1 | 5/2017 | Ma | |
| 2017/0292287 | A1 | 10/2017 | Lovely, II | |
| 2018/0080242 | A1 * | 3/2018 | Choi | E04H 15/50 |
| 2018/0080243 | A1 | 3/2018 | Choi | |
| 2018/0106066 | A1 * | 4/2018 | Choi | E04H 15/48 |
| 2018/0106067 | A1 * | 4/2018 | Choi | E04H 15/48 |
| 2018/0106068 | A1 * | 4/2018 | Choi | E04H 15/60 |
| 2018/0142493 | A1 * | 5/2018 | Choi | E04H 15/50 |

FOREIGN PATENT DOCUMENTS

| | | | |
|---|---|---|---|
| CN | 103590650 | B | 2/2014 |
| CN | 104265063 | A | 1/2015 |
| CN | 104358468 | A | 2/2015 |
| CN | 204163467 | U | 2/2015 |
| FR | 1 121 851 | | 8/1956 |
| FR | 68588 | | 5/1958 |
| JP | 4557885 | B2 | 10/2010 |
| WO | WO 2010/104939 | A1 | 9/2010 |
| WO | WO 2011/022764 | A1 | 3/2011 |
| WO | WO 2013/116545 | A1 | 8/2013 |

OTHER PUBLICATIONS

U.S. Appl. No. 29/600,927, filed Apr. 17, 2017.
U.S. Appl. No. 29/600,929, filed Apr. 17, 2017.
U.S. Appl. No. 15/709,222, filed Sep. 19, 2017.
U.S. Appl. No. 15/782,699, filed Oct. 12, 2017.
U.S. Appl. No. 15/782,717, filed Oct. 12, 2017.
U.S. Appl. No. 15/782,726, filed Oct. 12, 2017.
U.S. Appl. No. 15/821,019, filed Nov. 22, 2017.
U.S. Appl. No. 15/170,566, filed Jun. 1, 2016.
U.S. Appl. No. 15/170,587, filed Jun. 1, 2016.

* cited by examiner

EAVE STRUCTURE AND TENT FRAME WITH INTEGRATED EAVE STRUCTURE

CROSS-REFERENCE TO RELATED APPLICATIONS

The present application claims priority of Chinese Utility Model Applications CN 201621061701.7 filed on Sep. 19, 2016, the entire contents of which application are incorporated herein for all purposes by this reference.

FIELD OF THE INVENTION

The present invention generally relates to tent frames. More particularly, the present invention relates to eave structures and foldable tent frames with integrated eave structures.

BACKGROUND

There are a variety of tents. Usually, small-to-medium-sized tents are used for camping and large pavilion type foldable tents are used as outdoor sunshades.

An existing pavilion type tent includes supporting poles, an upper frame supported by the supporting poles and a tent cloth coving the upper frame. The shading area a tent can provide is directly proportional to the area formed by outer sides of the tent cloth. One way to increase the shading area is to enlarge the upper frame, for instance, by increasing the lengths of the poles constituting the upper frame. A drawback of having longer poles is that the folded tent may not be compact. In addition, to support a larger upper frame, additional supporting poles and/or other auxiliary elements are needed to ensure the stability of the tent. As a result, the weight of the tent is increased.

Another way to provide a larger shading area is to design a tent or tent frame with eave supporting frames. For instance, FIGS. 9 and 10 illustrate an existing tent including eave supporting frame 4' provided on an outer side of each supporting pole 1'. Eave supporting frame 4' includes eave main pole 41' and eave auxiliary pole 42'. One end of eave main pole 41' is pivotally connected to fixed seat 23' at the top end of the supporting pole 1' and the other end is connected with an outer side of the tent cloth. One end of eave auxiliary pole 42' is pivotally connected to sliding block 43' slidably coupled with supporting pole 1'. The other end of eave auxiliary pole 42' is pivotally connected to eave main pole 41'. Eave supporting frame 4' and upper frame 2' can be folded and unfolded together. It should be noted that sliding block 43' is necessary to ensure the proper folding and unfolding of the tent frame.

However, the configuration of eave supporting frame 4' with two poles (main and auxiliary poles) and additional sliding block increases the total number of poles and other elements needed for making a tent frame. It also makes the structure of the tent frame relatively complex. It further increases the size of the tent frame when folded.

In another existing tent frame, eave poles are slidably coupled to the fixed seats or the upper poles of the main frames. The eave poles cannot be folded or unfolded along with the main frame. Instead, the eave poles have to be manually and separately operated. For instance, the eave poles have to be manually pulled out after the main frame is unfolded, and have to be manually pushed in (or taken out) before folding the main frame. As such, the tent/tent frame is inconvenient to use.

Given the current state of the art, there remains a need for eave structures and tent frames that address the abovementioned issues.

The information disclosed in this Background section is provided for an understanding of the general background of the invention and is not an acknowledgement or suggestion that this information forms part of the prior art already known to a person skilled in the art.

SUMMARY

Various embodiments of the present invention provide eave structures and tent frames that are convenient to use, can help to provide larger shading areas when unfolded, and are compact when folded.

In some embodiments, the present invention provides an eave structure of a tent frame, where the tent frame includes a supporting pole, a first upper pole, a second upper pole and an oblique pole. The eave structure includes a sleeve member and an eave pole. The sleeve member is configured to be disposed at a first connector of the tent frame. The eave pole has a first end portion configured to be pivotally connected with the first upper pole, and a second end portion configured to be slidably coupled with the sleeve member. The first connector is fixedly coupled with an upper end portion of the supporting pole. A second connector of the tent frame is slidably coupled with the supporting pole and movable along the supporting pole below the first connector. A first end portion of the first upper pole is pivotally connected with a hub of the tent frame. A second end portion of the first upper pole is pivotally connected with the first end portion of the eave pole. A first end portion of the second upper pole is pivotally connected with the first upper pole at a position between the first and second end portions of the first upper pole. A second end portion of the second upper pole is pivotally connected with the first connector. A first end portion of the oblique pole is pivotally connected with the second upper pole at a position between the first and second end portions of the second upper pole. A second end portion of the oblique pole is pivotally connected with the second connector. When the tent frame is unfolded, the second end portion of the eave pole passes through the sleeve member and extends outwardly beyond the second upper pole.

In some embodiments, a pivoting member is disposed at the first connector, and fixedly coupled with or integrally formed with the first connector. In an embodiment, the pivoting member includes a groove to accommodate the second end portion of the second upper pole, and the sleeve member is rotatably coupled with a side of the pivoting member.

In some embodiments, the sleeve member is formed with a through hole through which the second end portion of the eave pole passes.

In an embodiment, the sleeve member is fixedly coupled with or integrally formed with the first connector at a top of the first connector.

In some embodiments, a pivoting member is disposed at the first connector apart from a side of the sleeve member, and fixedly coupled with or integrally formed with the first connector. In an embodiment, the second end portion of the second upper pole is disposed between the pivoting member and the sleeve member, and pivotally connected with one or more of the pivoting member and the sleeve member.

In some embodiments, the present invention provides an eave structure of a tent frame, where the tent frame includes a supporting pole, a first upper pole, a second upper pole and an oblique pole. The eave structure includes a first connector, a sleeve member and an eave pole. The first connector is configured to be fixedly coupled with an upper end portion of the supporting pole. The sleeve member is disposed at the first connector. The eave pole has a first end portion configured to be pivotally connected with the first upper pole, and a second end portion configured to be slidably coupled with the sleeve member. A second connector of the tent frame is slidably coupled with the supporting pole and movable along the supporting pole below the first connector. A first end portion of the first upper pole is pivotally connected with a hub of the tent frame. A second end portion of the first upper pole is pivotally connected with the first end portion of the eave pole. A first end portion of the second upper pole is pivotally connected with the first upper pole at a position between the first and second end portions of the first upper pole. A second end portion of the second upper pole is pivotally connected with the first connector. A first end portion of the oblique pole is pivotally connected with the second upper pole at a position between the first and second end portions of the second upper pole. A second end portion of the oblique pole is pivotally connected with the second connector. When the tent frame is unfolded, the second end portion of the eave pole passes through the sleeve member and extends outwardly beyond the second upper pole.

In some embodiments, the eave structure further includes the pivoting member disclosed herein.

In some further embodiments, the present invention provides a tent frame including a plurality of supporting poles, a plurality of first connectors, a plurality of second connectors, a hub, a plurality of first upper poles, a plurality of second upper poles, a plurality of oblique poles, two or more sleeve members, and two or more eave poles. Corresponding to each respective supporting pole in the plurality of supporting poles: a first connector in the plurality of first connectors is fixedly coupled with an upper end portion of the respective supporting pole; a second connector in the plurality of the second connectors is slidably coupled with the respective supporting pole and movable along the respective supporting pole below the first connector; a first end portion of a first upper pole in the plurality of first upper poles is pivotally connected with the hub; a first end portion of a second upper pole in the plurality of second upper poles is pivotally connected with the first upper pole at a position between the first end portion and a second end portion of the first upper pole; a second end portion of the second upper pole is pivotally connected with the first connector; a first end portion of an oblique pole in the plurality of oblique poles is pivotally connected with the second upper pole at a position between the first and second end portions of the second upper pole; a second end portion of the oblique pole is pivotally connected with the second connector. Corresponding to each respective first connector in two or more first connectors in the plurality of first connectors: a sleeve member in the two or more sleeve members is disposed at the respective first connector; an eave pole in the two or more eave poles has a first end portion pivotally connected with the second end portion of the first upper pole, and a second end portion passing through the sleeve member and extending outwardly beyond the second upper pole when the tent frame is unfolded; and the sleeve member and the eave pole collectively forms, or the first connector, the sleeve member and the eave pole collectively forms, an eave structure. When the tent frame is unfolded, the second end portion of each eave pole passes through the corresponding sleeve member and extends outwardly beyond the corresponding second upper pole.

In some embodiments, the number of first connectors, the number of eave members, and the number of eave poles are the same, with each first connector having a corresponding sleeve member and a corresponding eave pole.

In an embodiment, for each eave structure, the sleeve member is formed with a through hole through which the second end portion of the eave pole passes.

In some embodiments, each eave structure further includes a pivoting member disposed at the first connector, and fixedly coupled with or integrally formed with the first connector. In an embodiment, the pivoting member includes a groove to accommodate the second end portion of the second upper pole, and the sleeve member is rotatably coupled with a side of the pivoting member.

In an embodiment, for each eave structure, the sleeve member is fixedly coupled with or integrally formed with the first connector at a top of the first connector.

In some embodiments, each eave structure further includes a pivoting member disposed at the first connector apart from a side of the sleeve member, and fixedly coupled with or integrally formed with the first connector. In an embodiment, the second end portion of the second upper pole is disposed between the pivoting member and the sleeve member, and pivotally connected with one or more of the pivoting member and the sleeve member.

The eave structures and tent frames of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
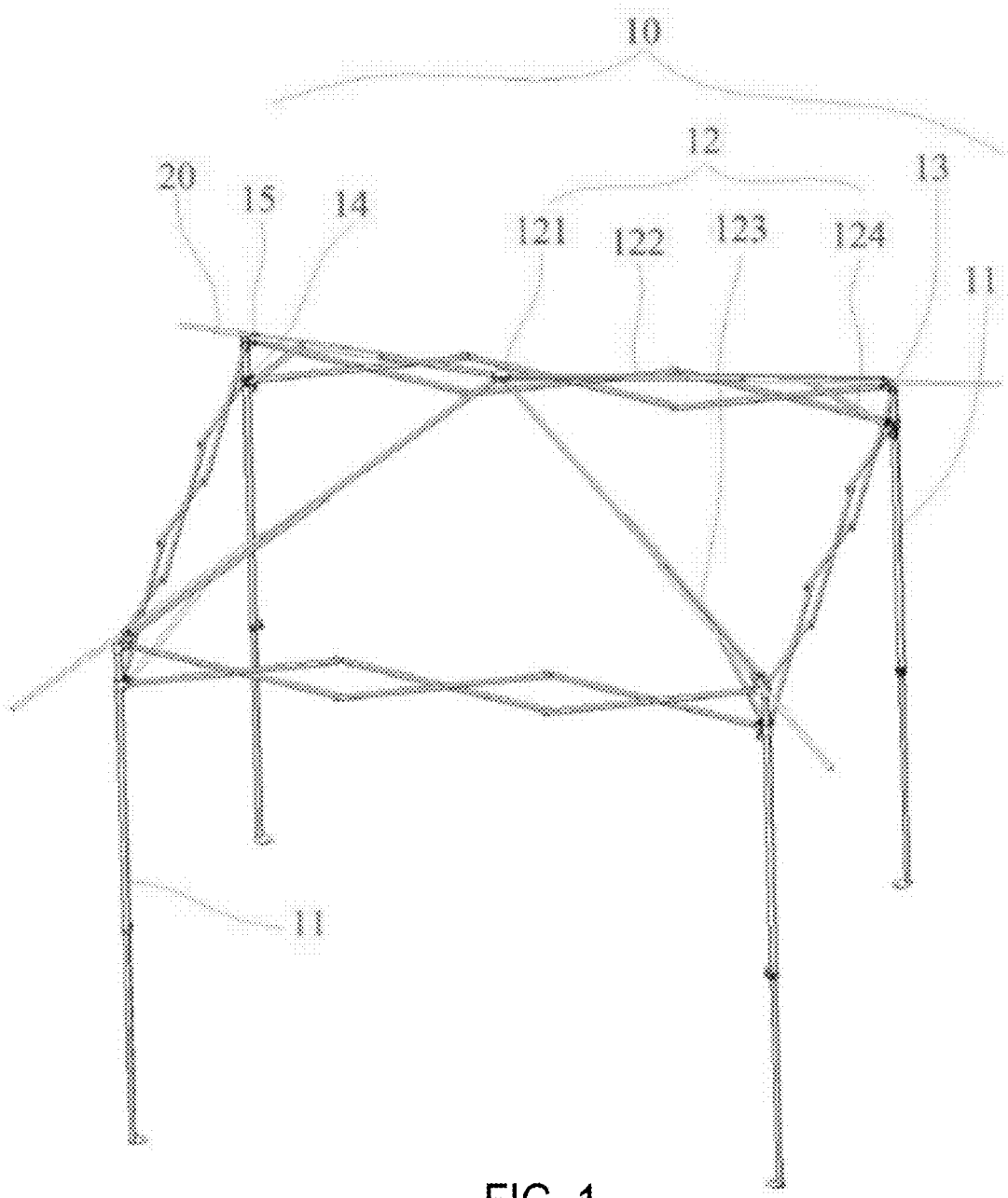
FIG. 1 is a schematic view illustrating a tent frame in an unfolded state in accordance with exemplary embodiments of the present invention.

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from their spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of eave structures and tent frames having such eave structures. Generally, a tent frame of the present invention includes a plurality of supporting poles and an upper frame connected with the plurality of supporting poles. It can be of various sizes and shapes, and can include various number of supporting poles such as three, four, five or more supporting poles. A tent frame of the present invention also includes a plurality of eave structures, the number of which can be varied depending on applications, preferences or the like. For instance, it can include two eave structures, three eave structures, or as many as the number of the supporting poles.

An eave structure usually includes an eave pole, and a mechanism connecting the eave pole with the upper frame and one of the supporting poles (the supporting pole or an element disposed at the supporting pole). When the tent frame is unfolded, the eave pole extends beyond the upper frame and/or the supporting pole. Such an eave pole, along with the upper frame, can be used to support a tent cloth such as a canopy. As the eave pole extends beyond the upper frame and/or the supporting pole, it helps to increase the shading area, and/or shed rain or snow away from the sides of the tent.

Figure 3:
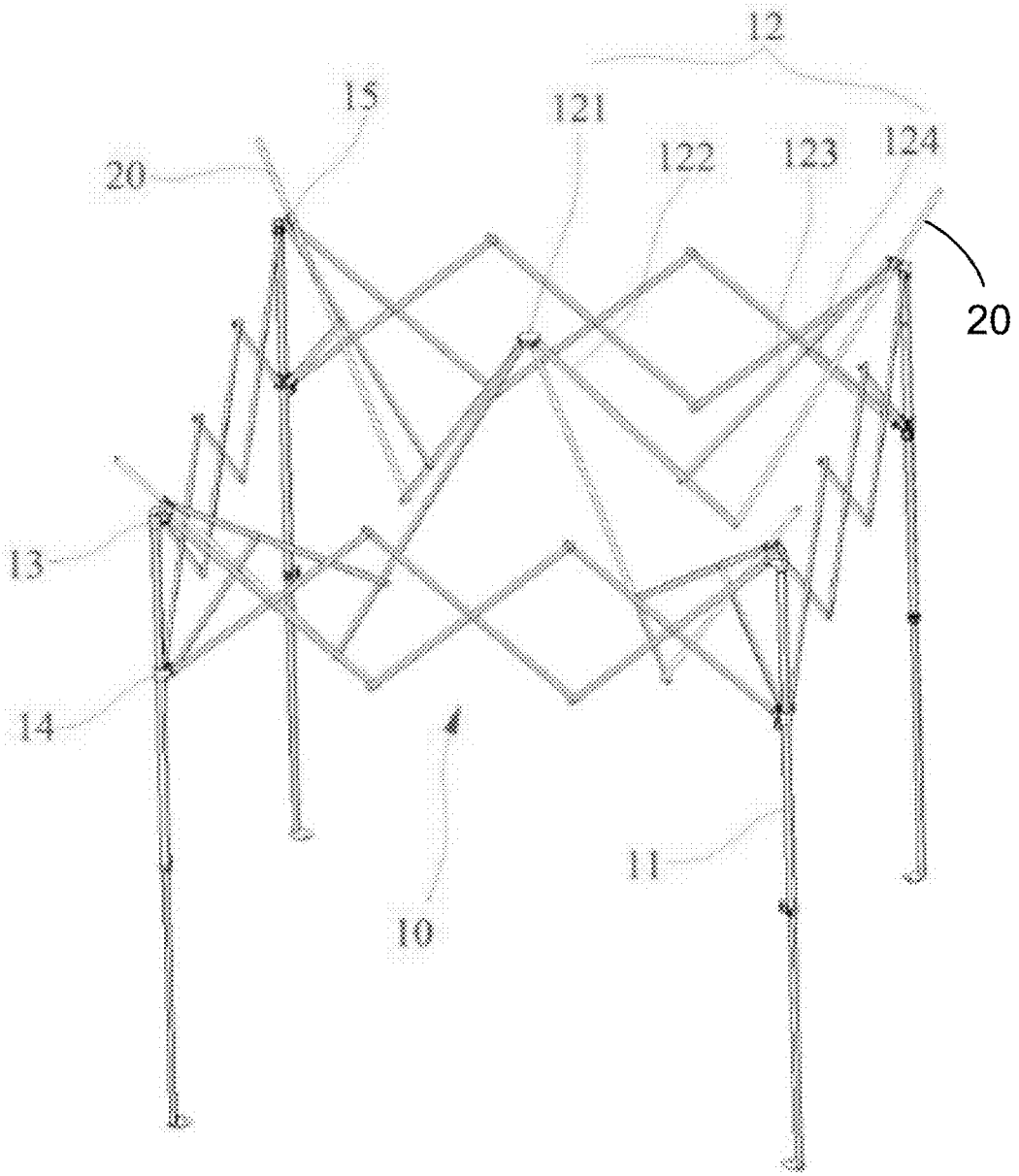
FIG. 3 is a schematic view illustrating the tent frame of FIG. 1 in a semi-folded state in accordance with exemplary embodiments of the present invention.

Referring now to FIGS. 1 and 3, there is depicted an exemplary tent frame in an unfolded state and in a semi-folded state in accordance with some exemplary embodiments of the present invention. As shown, tent frame 10 includes a plurality of supporting poles 11, with a plurality of first connectors 13 and a plurality of second connectors 14 disposed on the supporting poles to connect the supporting poles with other elements of the tent frame. In some embodiments, each first connector is fixedly coupled with a supporting pole at an upper end portion (e.g., the top) of the supporting pole. Each second connector is slidably coupled with a supporting pole and is movable along the supporting pole below the first connector.

Tent frame 10 also includes an upper frame such as upper frame 12 coupled with the plurality of supporting poles. Upper frame 12 is disposed above and supported by the plurality of support poles when the tent frame is unfolded. In some embodiments, upper frame 12 includes hub 121, a plurality of first upper poles 122, a plurality of second upper poles 123, and a plurality of oblique poles 124. Each of the first upper poles, second upper poles and oblique poles has a first end portion and a second end portion. The first end portion of each first upper pole 122 is pivotally connected with the hub. The first end portion of each second upper pole 123 is pivotally connected with the corresponding first upper pole at a position between the first end portion and a second end portion of the corresponding first upper pole. The second end portion of each second upper pole 123 is pivotally connected with the corresponding first connector. The first end portion of each oblique pole 124 is pivotally connected with the corresponding second upper pole at a position between the first and second end portions of the corresponding second upper pole. The second end portion of each oblique pole 124 is pivotally connected with the corresponding second connector.

The tent frame further includes two or more eave poles 20, and mechanisms to couple the eave poles with the upper frame and the supporting poles (the supporting poles or elements disposed at the supporting poles). Collectively, an eave pole and a mechanism to couple the eave pole with the upper frame and a supporting pole are referred herein as an eave structure.

Referring in particular to FIG. 3, in some embodiments, each eave pole 20 has a first end portion and a second end portion. The first end portion of each eave pole 20 is pivotally connected with the second end portion of the corresponding first upper pole 122. The second end portion of each eave pole 20 is coupled with the corresponding supporting pole 11. In some embodiments, an eave structure includes a sleeve member such as sleeve member 15 to couple eave pole 20 with a supporting pole. Sleeve member 15 is configured to slidably couple with (e.g., sleeve on) the second end portion of the eave pole. As such, sleeve member 15 allows the second end portion of the eave pole to extend beyond the upper frame when the tent frame is unfolded and retract back when the tent frame is folded.

Figure 2:
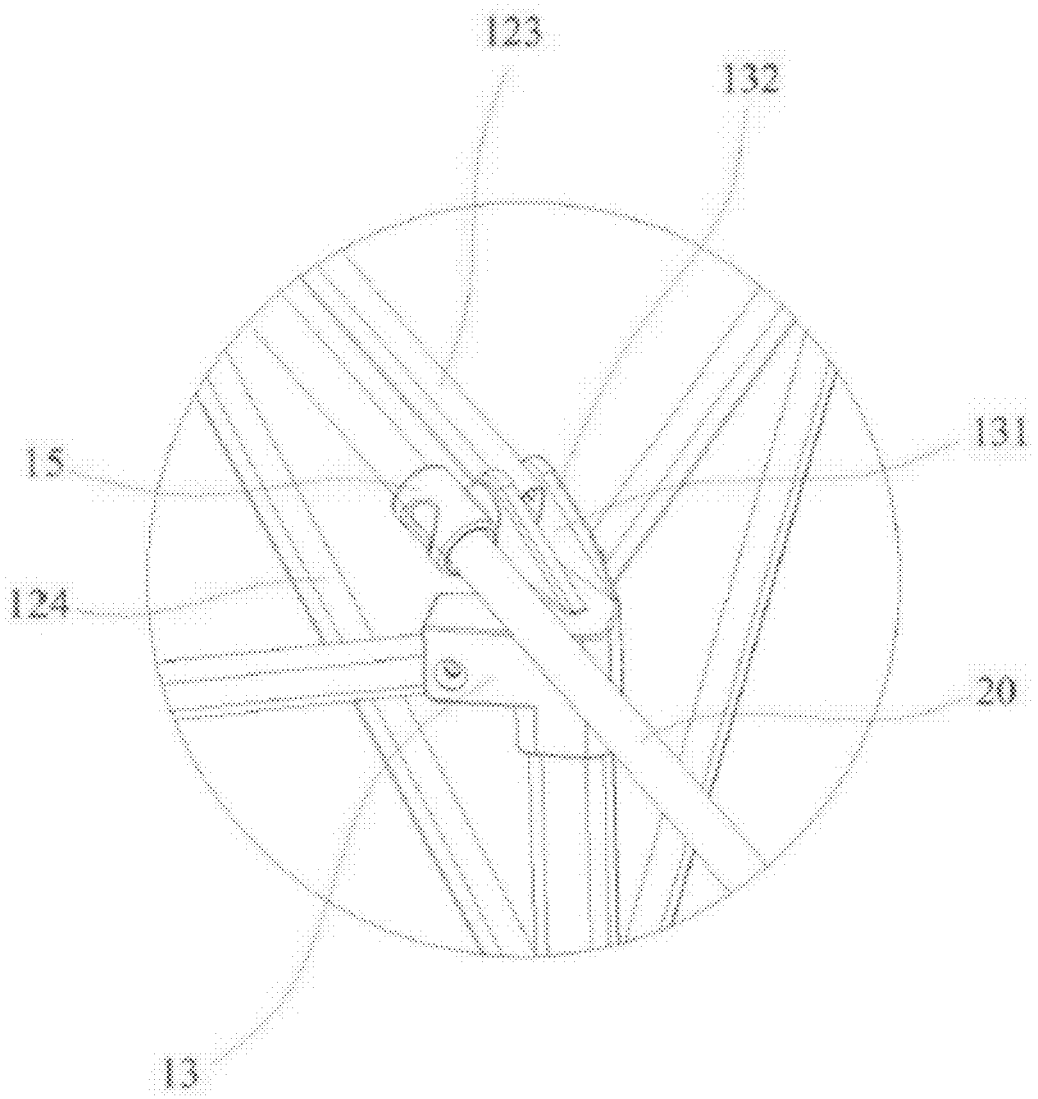
FIG. 2 is a schematic view illustrating an eave structure of a tent frame in an unfolded state in accordance with exemplary embodiments of the present invention.
Figure 4:
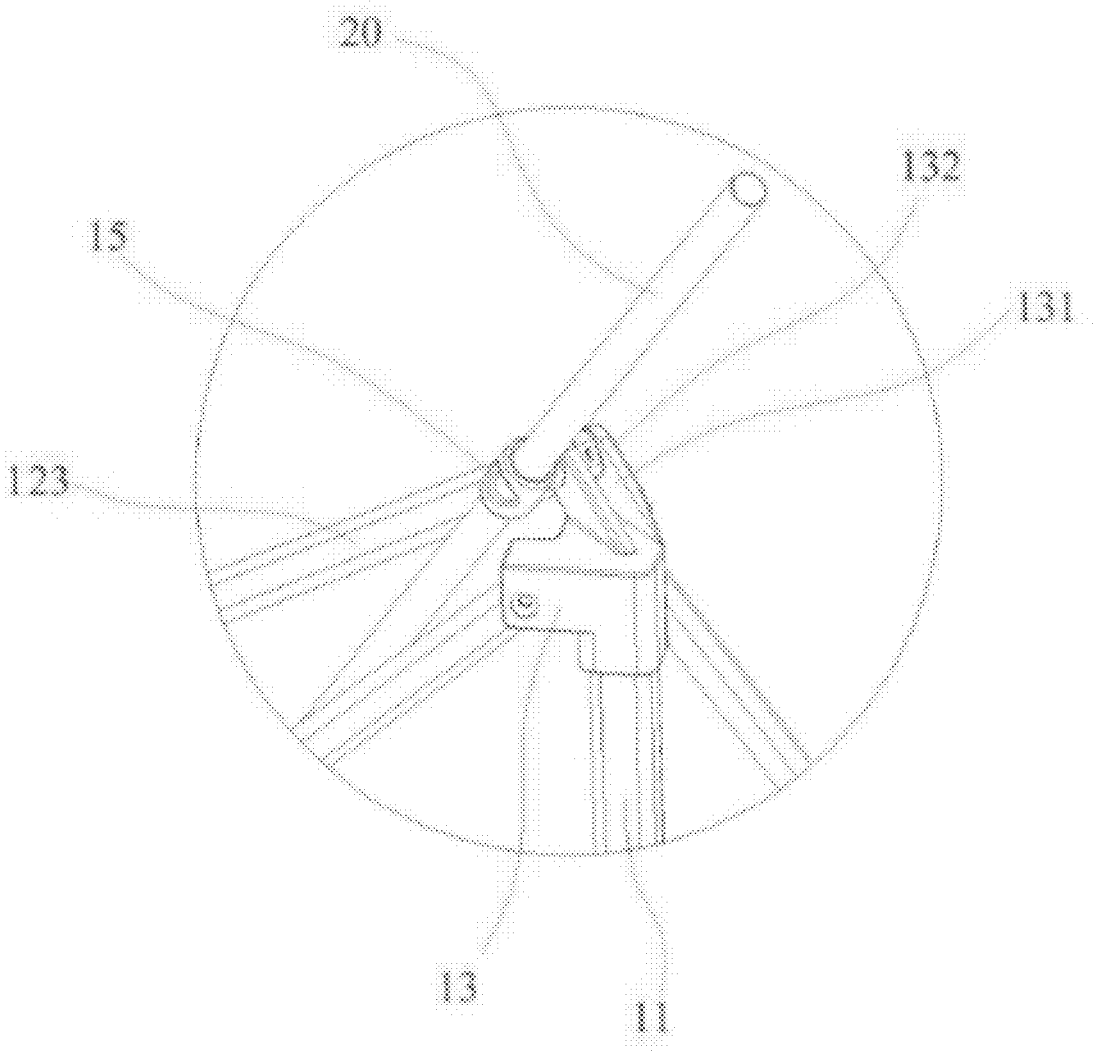
FIG. 4 is a schematic view illustrating an eave structure of a tent frame in a semi-folded state in accordance with exemplary embodiments of the present invention.

Sleeve member 15 can be disposed at first connector 13 or at other components coupled/formed with the first connector. For instance, referring to FIGS. 2 and 4, in some embodiments, sleeve member 15 is disposed at a pivoting member such as pivoting member 132 fixedly coupled or integrally formed with first connector 13. In an embodiment, pivoting member 132 includes a groove such as groove 131 to accommodate the second end portion of the corresponding second upper pole 123. In an embodiment, sleeve member 15 is rotatably coupled with a side of pivoting member 132.

Alternatively, in some embodiments, sleeve member 15 is fixedly coupled or integrally formed with the first connector. For instance, referring to FIGS. 6-9, sleeve member 15 is fixedly coupled or integrally formed with first connector 13 at a top of the first connector. In some embodiments, sleeve member 15 is formed with a through hole such as through hole 151 for slidably coupling with eave pole 20. When the tent frame is unfolded, the through hole of sleeve member 15 allows the second end portion of eave pole 20 to pass through and extend outwardly beyond the second upper pole 123 and/or beyond supporting pole 11.

Alternatively, in some embodiments, a pivoting member such as pivoting member 16 is disposed at the first connector apart from a side of the sleeve member. Pivoting member 16 is fixedly coupled with or integrally formed with the first connector. In such an embodiment, the second end portion of second upper pole 123 is disposed between the pivoting member and the sleeve member, and pivotally connected with one or more of the pivoting member and the sleeve member.

In some embodiments, the first connector is a constituent of the eave structure. In an embodiment, the first connector and the pivoting member are constituents of the eave structure.

It should be noted that a tent frame of the present invention can include a various number of eave structures, depending on the application, preference, or the like. For instance, in an embodiment where only one side of the tent needs shades, the tent frame can include two eave structures, with each eave structure connected with one of two adjacent supporting poles. In an embodiment where two sides of the tent need shades, the tent frame can include three eave structures, with each eave structure connected with one of three adjacent supporting poles. In a further embodiment where all sides of the tent need shades, the tent frame can include the same number of eave structures as the supporting poles, with each eave structure connected with one of the supporting poles.

The eave structure of the present invention can be folded and unfolded along with the other elements of the tent frame. For instance, referring to FIGS. 1-2 and 6-7, in some embodiments, when unfolding the tent frame, first upper pole 122 and second upper poles 123 are unfolded to form a substantially straight line. The first end portion of eave pole 20 moves upwardly along with the first upper pole, pushing the second end portion of eave pole 20 outwardly beyond the upper frame and/or the supporting pole. When unfolded, the eave pole is sloped substantially the same as the first and second upper poles.

Figure 5:
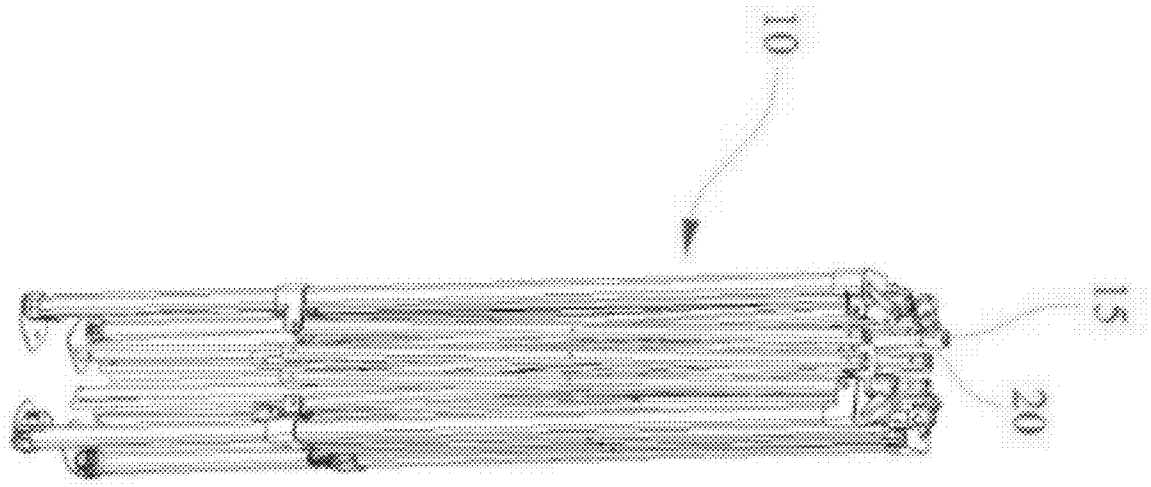
FIG. 5 is a schematic view illustrating the tent frame of FIG. 1 in a folded state in accordance with exemplary embodiments of the present invention.
Figure 6:
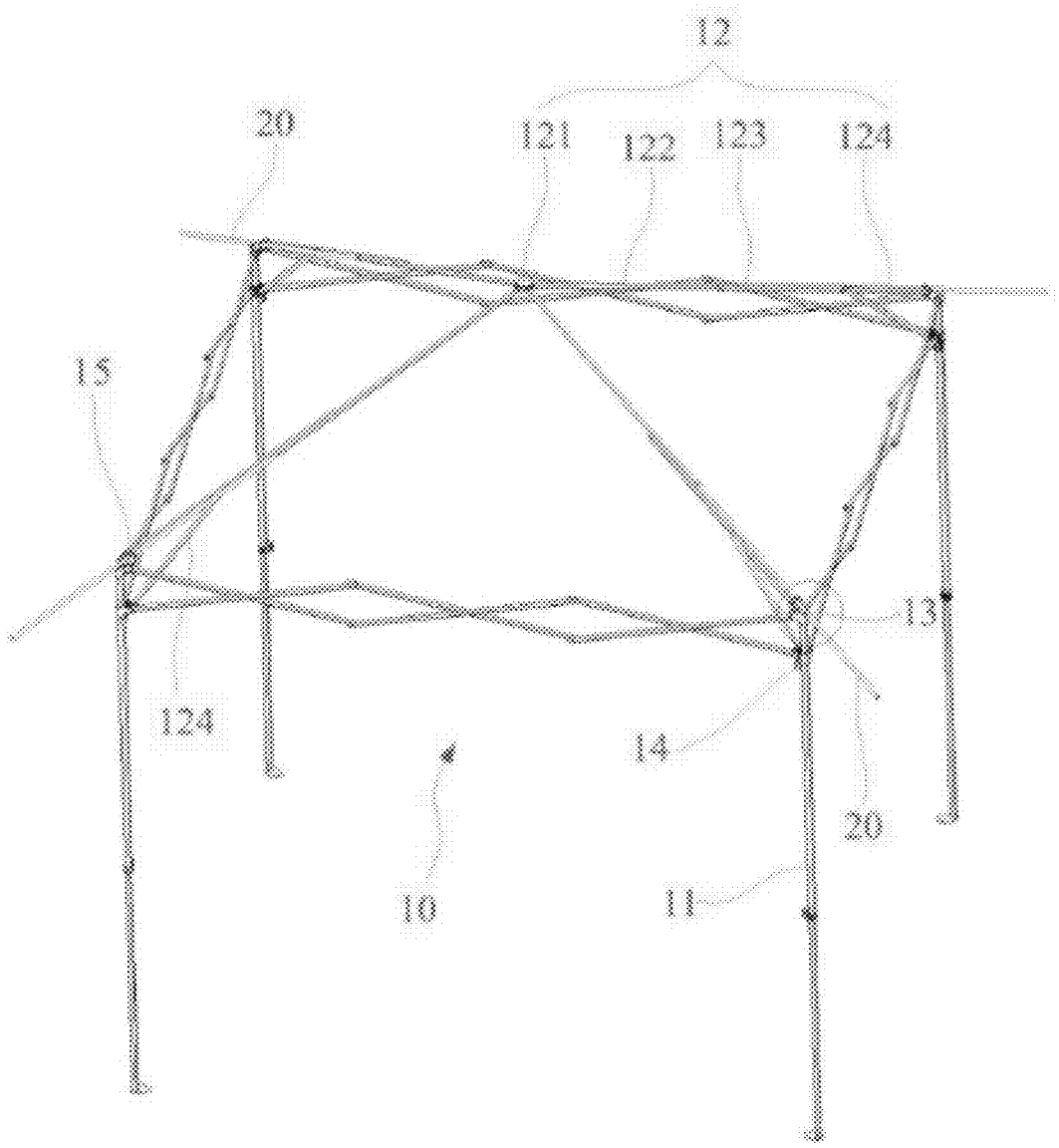
FIG. 6 is a schematic view illustrating a tent frame in an unfolded state in accordance with exemplary embodiments of the present invention.
Figure 7:
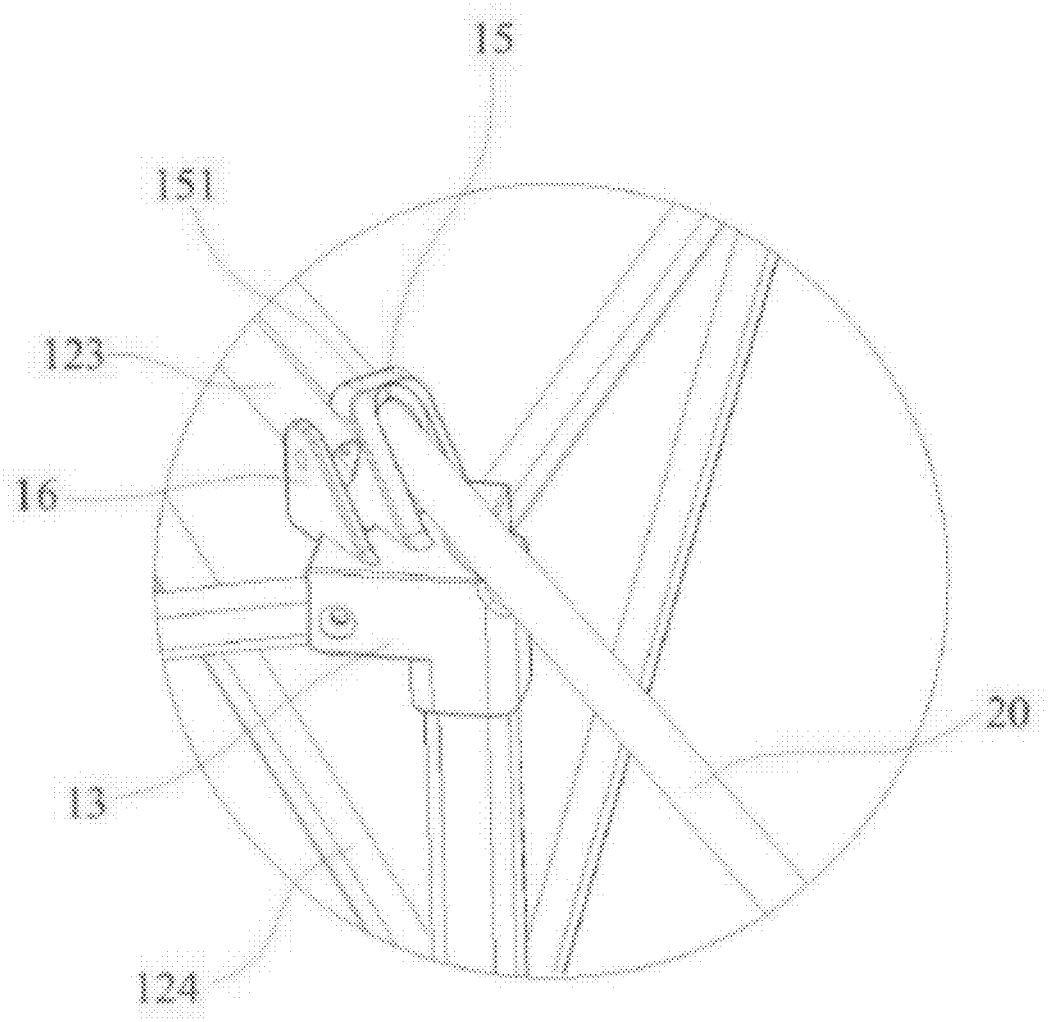
FIG. 7 is a schematic view illustrating an eave structure of a tent frame in an unfolded state in accordance with exemplary embodiments of the present invention.
Figure 8:
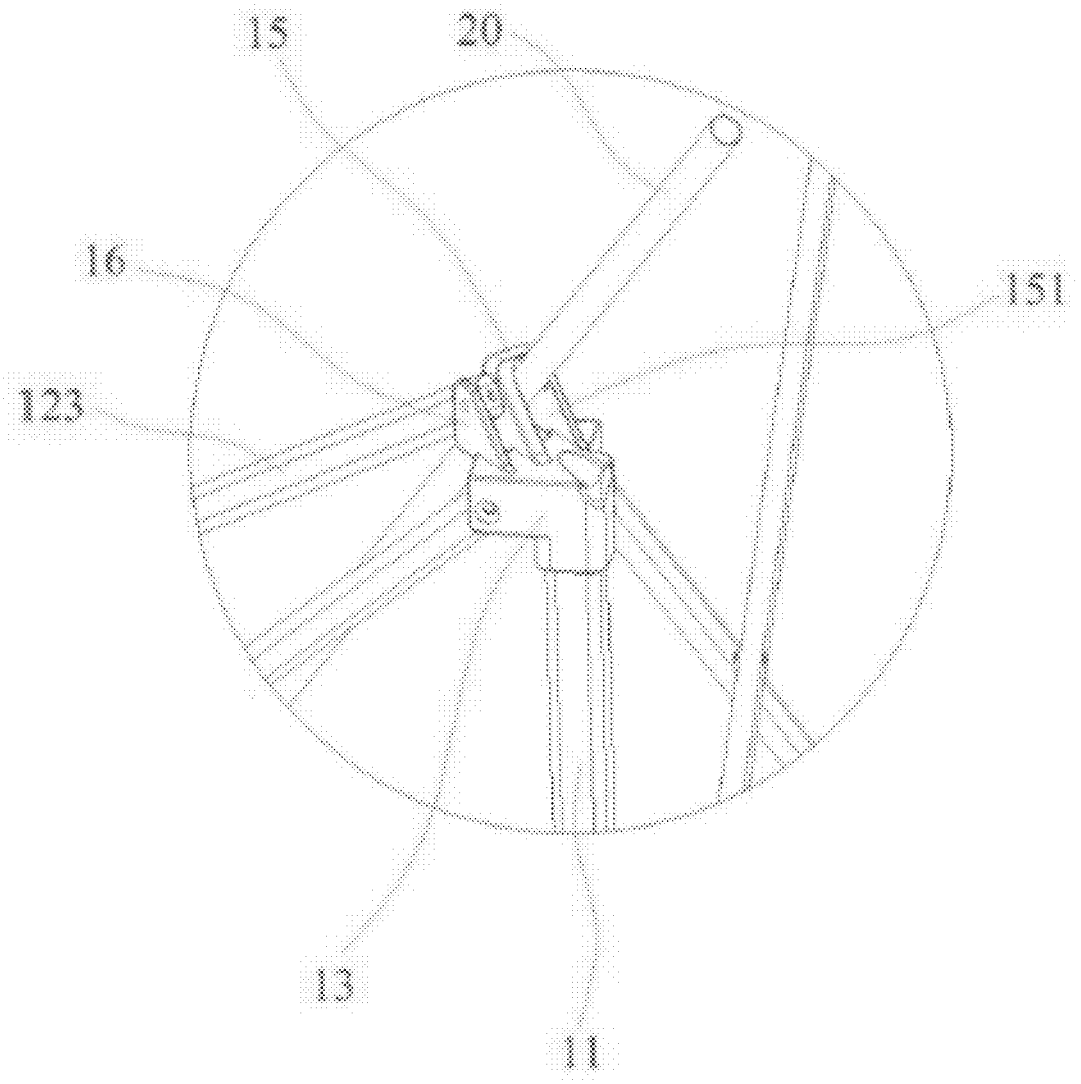
FIG. 8 is a schematic view illustrating an eave structure of a tent frame in semi-folded state in accordance with exemplary embodiments of the present invention.
Figure 9:
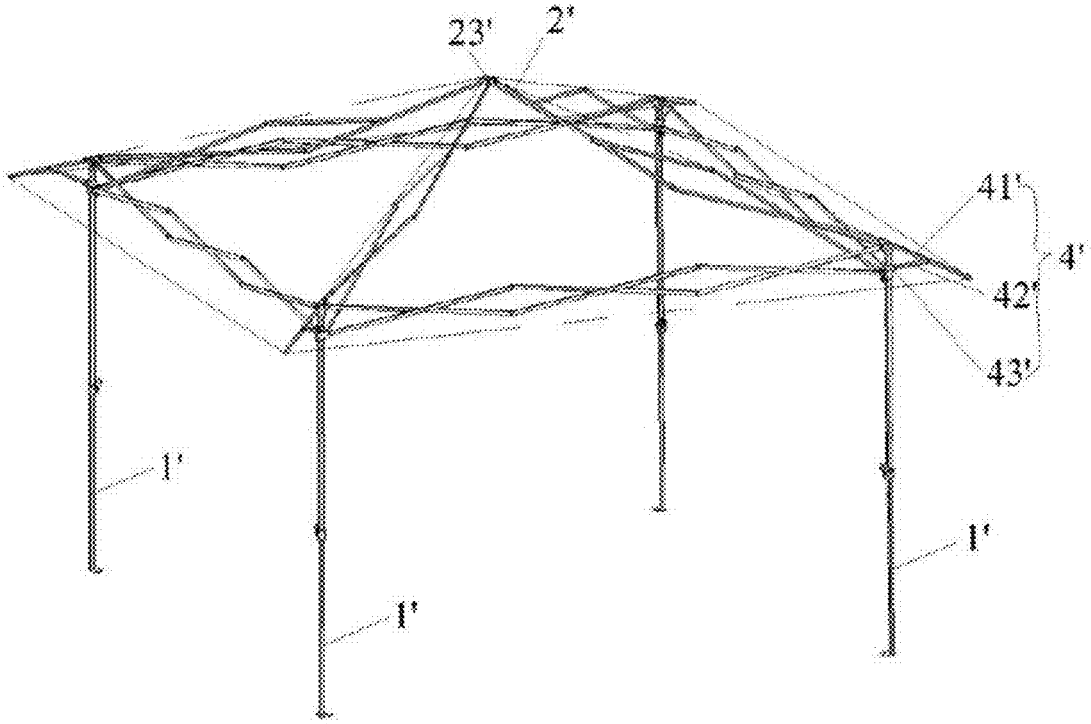
FIG. 9 (Related Art)
FIG. 9 is a schematic view illustrating a tent frame of related art.
Figure 10:
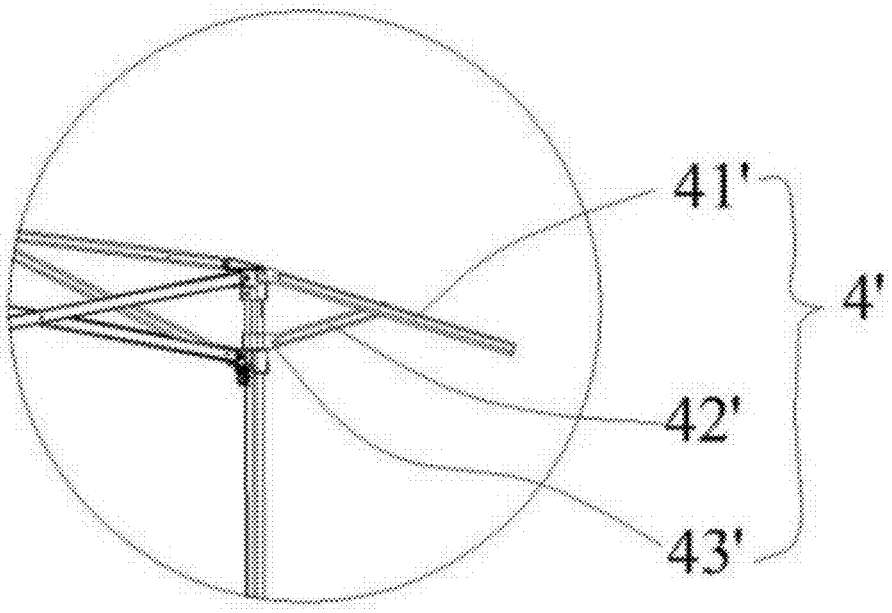
FIG. 10 (Related Art)
FIG. 10 is an enlarged view illustrating an eave structure of FIG. 9.

Referring to FIGS. 3-5 and 8, when folding the tent frame, second connector 14 slides downwardly along supporting pole 11, pulling oblique pole 124 downwardly. In turn, the oblique pole pulls downwardly second upper pole 123, and the second upper pole pulls downwardly first upper pole 122. Accordingly, the first end portion of eave pole 20 moves downwardly, pulling the second end portion of eave pole 20 to retract back to the sleeve member. As illustrated in FIG. 5, the folded tent frame (or tent) is compact with all poles folded towards each other.

As disclosed herein, when the tent frame is unfolded, the second end portion of eave pole 20 extends outwardly beyond the upper frame and the supporting pole. Thus, the eave structure of the present invention can be used to extend a tent cloth such as a canopy beyond the side(s) of the tent. As a result, it can help to provide a larger shading area in sunny days. It also helps to smooth the tent cloth/canopy, and thus helps to shed snow and rain away from the sides of the tent, reducing the risk of water (e.g., rain) and snow accumulation in snowy and raining days. Moreover, the tent frame of the present invention is convenient to use as the eave structure of the present invention can be folded and unfolded along with other elements of the tent frame. Further, the tent frame of the present invention when folded is compact as the eave poles are retracted and folded together with all of the other poles of the tent frame, making it easy to carry and store.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", "upwardly" or "downwardly", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first connector could be termed a second connector, and, similarly, a second connector could be termed a first connector, without changing the meaning of the description, so long as all occurrences of the "first connector" are renamed consistently and all occurrences of the "second connector" are renamed consistently.

What is claimed is:

1. An eave structure of a tent frame, wherein the tent frame comprises a supporting pole, a first upper pole, a second upper pole and an oblique pole, the eave structure comprising:

a sleeve member configured to be disposed at a first connector of the tent frame; and an eave pole having a first end portion configured to be pivotally connected with the first upper pole, and a second end portion configured to be slidably coupled with the sleeve member, wherein when the tent frame is unfolded, the second end portion of the eave pole passes through the sleeve member and extends outwardly beyond the second upper pole, wherein:

the first connector is fixedly coupled with an upper end portion of the supporting pole;

a second connector of the tent frame is slidably coupled with the supporting pole and movable along the supporting pole below the first connector;

a first end portion of the first upper pole is pivotally connected with a hub of the tent frame;

a second end portion of the first upper pole is pivotally connected with the first end portion of the eave pole;

a first end portion of the second upper pole is pivotally connected with the first upper pole at a position between the first and second end portions of the first upper pole;

a second end portion of the second upper pole is pivotally connected with the first connector;

a first end portion of the oblique pole is pivotally connected with the second upper pole at a position between the first and second end portions of the second upper pole; and a second end portion of the oblique pole is pivotally connected with the second connector.

2. The eave structure of claim 1, wherein a pivoting member is disposed at the first connector, and fixedly coupled with or integrally formed with the first connector, wherein the pivoting member comprises a groove to accommodate the second end portion of the second upper pole, and the sleeve member is rotatably coupled with a side of the pivoting member.

3. The eave structure of claim 1, wherein the sleeve member is formed with a through hole through which the second end portion of the eave pole passes.

4. The eave structure of claim 1, wherein the sleeve member is fixedly coupled with or integrally formed with the first connector at a top of the first connector.

5. The eave structure of claim 4, wherein a pivoting member is disposed at the first connector apart from a side of the sleeve member, and fixedly coupled with or integrally formed with the first connector, wherein the second end portion of the second upper pole is disposed between the pivoting member and the sleeve member, and pivotally connected with one or more of the pivoting member and the sleeve member.

6. An eave structure of a tent frame, wherein the tent frame comprises a supporting pole, a first upper pole, a second upper pole and an oblique pole, the eave structure comprising:

a first connector configured to be fixedly coupled with an upper end portion of the supporting pole;

a sleeve member disposed at the first connector; and an eave pole having a first end portion pivotally connected with the first upper pole, and a second end portion configured to be slidably coupled with the sleeve member, wherein when the tent frame is unfolded, the second end portion of the eave pole passes through the sleeve member and extends outwardly beyond the second upper pole, wherein:

a second connector is slidably coupled with the supporting pole and movable along the supporting pole below the first connector;

a first end portion of the first upper pole is pivotally connected with a hub of the tent frame;

a second end portion of the first upper pole is pivotally connected with the first end portion of the eave pole;

a first end portion of the second upper pole is pivotally connected with the first upper pole at a position between the first and second end portions of the first upper pole;

a second end portion of the second upper pole is pivotally connected with the first connector;

a first end portion of the oblique pole is pivotally connected with the second upper pole at a position between the first and second end portions of the second upper pole; and a second end portion of the oblique pole is pivotally connected with the second connector.

7. The eave structure of claim 6, wherein the sleeve member is formed with a through hole through which the second end portion of the eave pole passes.

8. The eave structure of claim 6, further comprising:

a pivoting member disposed at the first connector, and fixedly coupled with or integrally formed with the first connector, wherein the pivoting member comprises a groove to accommodate the second end portion of the second upper pole, and the sleeve member is rotatably coupled with a side of the pivoting member.

9. The eave structure of claim 6, wherein the sleeve member is fixedly coupled with or integrally formed with the first connector at a top of the first connector.

10. The eave structure of claim 9, further comprising:

a pivoting member is disposed at the first connector apart from a side of the sleeve member, and fixedly coupled with or integrally formed with the first connector, wherein the second end portion of the second upper pole is disposed between the pivoting member and the sleeve member, and pivotally connected with one or more of the pivoting member and the sleeve member.

11. A tent frame with integrated eave structures, comprising:

a plurality of supporting poles;

a plurality of first connectors;

a plurality of second connectors;

a hub;

a plurality of first upper poles;

a plurality of second upper poles;

a plurality of oblique poles;

two or more sleeve members; and two or more eave poles, wherein corresponding to each respective supporting pole in the plurality of supporting poles:

a first connector in the plurality of first connectors is fixedly coupled with an upper end portion of the respective supporting pole;

a second connector in the plurality of the second connectors is slidably coupled with the respective supporting pole and movable along the respective supporting pole below the first connector;

a first end portion of a first upper pole in the plurality of first upper poles is pivotally connected with the hub;

a first end portion of a second upper pole in the plurality of second upper poles is pivotally connected with the first upper pole at a position between the first end portion and a second end portion of the first upper pole;

a second end portion of the second upper pole is pivotally connected with the first connector;

a first end portion of an oblique pole in the plurality of oblique poles is pivotally connected with the second upper pole at a position between the first and second end portions of the second upper pole;

a second end portion of the oblique pole is pivotally connected with the second connector;

wherein corresponding to each respective first connector in two or more first connectors in the plurality of first connectors:

a sleeve member in the two or more sleeve members is disposed at the respective first connector;

an eave pole in the two or more eave poles has a first end portion pivotally connected with the second end portion of the first upper pole, and a second end portion slidably coupled with the sleeve member, wherein when the tent frame is unfolded, the second end portion of the eave pole passes through the sleeve member and extends outwardly beyond the second upper pole; and wherein the sleeve member and the eave pole collectively forms, or the first connector, the sleeve member and the eave pole collectively forms, an eave structure.

12. The tent frame of claim 11, wherein the number of first connectors, the number of eave members, and the number of eave poles are the same, wherein each first connector has a corresponding sleeve member and a corresponding eave pole.

13. The tent frame of claim 11, wherein for each eave structure, the sleeve member is formed with a through hole through which the second end portion of the eave pole passes.

14. The tent frame of claim 11, wherein each eave structure further comprises:

a pivoting member disposed at the first connector, and fixedly coupled with or integrally formed with the first connector, wherein the pivoting member comprises a groove to accommodate the second end portion of the second upper pole, and the sleeve member is rotatably coupled with a side of the pivoting member.

15. The tent frame of claim 11, wherein for each eave structure, the sleeve member is fixedly coupled with or integrally formed with the first connector at a top of the first connector.

16. The tent frame of claim 15, wherein each eave structure further comprises:

a pivoting member is disposed at the first connector apart from a side of the sleeve member, and fixedly coupled with or integrally formed with the first connector, wherein the second end portion of the second upper pole is disposed between the pivoting member and the sleeve member, and pivotally connected with one or more of the pivoting member and the sleeve member.

* * * * *